United States Patent [19]

Gilda et al.

[11] Patent Number: 5,016,754

[45] Date of Patent: May 21, 1991

[54] COLLAPSIBLE ASHTRAY

[75] Inventors: Patricia Gilda, Monterey, Calif.; William F. Mann; Winthrop D. Allen, III, both of Bisbee, Ariz.

[73] Assignee: Ashaway, Ltd., Monterey, Calif.

[21] Appl. No.: 195,390

[22] Filed: May 10, 1988

Related U.S. Application Data

[63] Continuation of Ser. No. 803,352, Dec. 2, 1975, abandoned, which is a continuation-in-part of Ser. No. 735,799, May 17, 1985, abandoned.

[51] Int. Cl.[5] ..... B65D 73/00

[52] U.S. Cl. ..... 206/496; 206/135; 206/136; 206/120; 206/246

[58] Field of Search ..... 206/135, 120, 136, 246, 206/496

[56] References Cited

U.S. PATENT DOCUMENTS

| | | | |
|---|---|---|---|
| 1,364,556 | 1/1921 | Hurff . | |
| 1,430,720 | 10/1922 | Bowerman . | |
| 1,816,049 | 7/1931 | Larner . | |
| 2,071,394 | 2/1937 | Douglas | 206/37 |
| 2,291,753 | 8/1942 | Patten | 229/37 |
| 2,432,656 | 12/1947 | Cook | 131/241 |
| 2,506,962 | 5/1950 | Madan | 131/240 |
| 2,720,903 | 10/1955 | Pickren . | |
| 2,796,067 | 6/1957 | McCutcheon et al. . | |
| 2,836,340 | 5/1958 | Crowley | 206/496 |
| 3,275,130 | 9/1966 | Van Leeuwen | 206/117 |
| 3,342,317 | 9/1967 | Barron | 206/37 |
| 3,372,724 | 3/1968 | Rouse | 150/30 |
| 3,561,670 | 2/1971 | Segal | 229/53 |
| 4,328,895 | 5/1982 | Jaeger | 206/496 |
| 4,349,036 | 9/1982 | Harvey et al. | 131/240 |
| 4,577,758 | 3/1986 | Gilda et al. | 206/496 |

FOREIGN PATENT DOCUMENTS

| | | |
|---|---|---|
| 2613449 | 10/1977 | Fed. Rep. of Germany . |
| 2235575 | 1/1975 | France . |
| 38-227 | 1/1963 | Japan . |
| 50-126587 | 10/1975 | Japan . |
| 106873 | 5/1953 | New Zealand . |
| 112112/3 | 1/1956 | New Zealand . |

*Primary Examiner*—Joseph Man-Fu Moy
*Attorney, Agent, or Firm*—Townsend and Townsend

[57] ABSTRACT

A collapsible ashtray includes a pair of panels joined by a pleated sheet which defines an ash receptacle when the panels are pulled apart. The pleated sheet includes at least one step formed therein for holding lighted cigarettes. In one embodiment, the panels are joined to form a hinge, and the ashtray may be folded and unfolded along this hinge. In another embodiment, the panels are not joined so that the panels may be pulled apart in a parallel fashion.

12 Claims, 5 Drawing Sheets

COLLAPSIBLE ASHTRAY

This is a Continuation of application Ser. No. 06/803,352, filed Dec. 2, 1984, now abandoned.

This application is a continuation-in-part of application Ser. No. 735,799 filed on May 17, 1985.

BACKGROUND OF THE INVENTION

1. Field of the Invention

This invention relates in general to refuse receptacles and in particular to ashtrays.

For smokers in public establishments such as bars, restaurants, hotels, conference centers and offices, it is desirable to have available ashtrays which are lightweight, safe and easy to handle. For those who own and operate such public establishments, the cost and inconvenience of providing and cleaning ashtrays, and the cost of replacing stolen ashtrays frequently inhibit them from providing adequate numbers of ashtrays to meet smoker's needs.

People who enjoy outdoor activities such as camping, fishing, and people who travel in vehicles have also experienced the need for safe and convenient ashtrays. It is thus desirable to provide ashtrays that are easy to use, carry and dispose. Collapsible and disposable ashtrays are particularly desirable.

2. Description of the Prior Art

A number of disposable ashtrays have been proposed. See, for example, U.S. Pat. Nos. 1,364,556; 1,430,720; 2,071,394; 2,432,656; 3,342,317; 3,372,724; 3,561,670; and 4,349,036. Of particular interest is U.S. Pat. No. 2,071,394 to Douglas which discloses an ashtray constructed similarly to a paperbox. A flat piece of material is creased at several places, and end pieces are lapped together and fastened by gluing. When assembled, the ashtray is in a shape of a cup with an inverted triangular cross-section. The ashtray has two legs, one on each side to support the ashtray in an upright position. The ashtray may be folded to make a flat assembly and has cut out holes forming rests for cigarettes. Although compact and generally suitable for its intended purpose, the Douglas ashtray is inherently unstable as it tends to tilt about the inverted-triangular base. The legs only partly overcome this instability since they will tend to fold outward, particularly when a cigarette is placed on the ashtray. To further overcome the instability, a modified design having leg portions with interlocking extension to form a more rigid structure is disclosed. While the latter design cures the instability, it is much less convenient since it requires that they ashtray be assembled. Although the assembly required is minimal, even the simplest assembly will require time and effort by the unfamiliar user. Thus, it would be desirable to provide a foldable ashtray which requires virtually no assembly whatsoever.

In U.S. Pat. No. 1,364,556 to Hurff discloses a foldable ashtray having generally the same shape as that of Douglas. An inverted triangular cup is supported by foldable members on two sides which are in turn supported by a flat base formed by foldable sections. Thus, when the base is folded upwards along the center line the two support members for the cup and the cup itself are all folded into a flat package. It is the flat base which prevents the foldable members from collapsing. The need to provide a flat base, however, greatly increases the difficulty of assembling the ashtray and results in a relatively bulk structure when folded. Moreover, the Hurff ashtray construction requires flexible strip members to serve as the hinge connecting the two sections of the base and a pivoted clip member to keep the whole assembly in position so that the receiver may be expensive to manufacture.

SUMMARY OF THE INVENTION

The collapsible ashtray of the present invention is particularly convenient to use as it is highly compact when folded, yet is made ready for use by simply pulling apart two side panels. The resulting unfolded structure is very stable and is not prone to collapse during use. Moreover, the ashtray is simple and economic to manufacture, and overcomes the shortcomings of the prior art described above.

The foregoing advantages are obtained by using three basic structural elements: two side panels and a pleated sheet extending therebetween. The pleated sheet is characterized by a stepped-profile so that it includes a first horizontal segment defining a ledge for supporting a cigar or cigarette, a second horizontal portion beneath the first horizontal portion for defining an ash receptacle, and a vertical wall extending between the two horizontal portions to complete the ash receptacle.

In the preferred embodiment of the foldable ashtray of the present invention, the two panels are joined along a common edge which defines a hinge so that the panels may be opened and closed along said hinge. The first horizontal portion of the pleated sheet extends inward from the distal end of the panel toward the hinged edge. The second horizontal portion extends the remainder of the distance.

In an alternate embodiment, the two side panels are not directly joined to one another. Instead, the pleated sheet includes a pair of horizontal portions extending inward from the edge of the panels, and a third horizontal segment defining the receptacle therebetween. The stepped profile of the folded member has been found to provide a sufficiently rigid structure so that the ashtray is highly stable and resistant to collapse when in use.

DESCRIPTION OF THE PREFERRED EMBODIMENT

Figure 1:
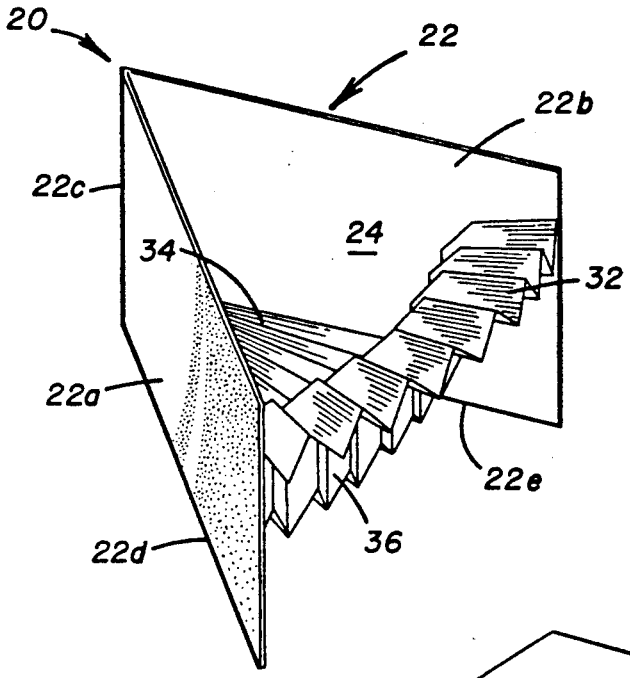
FIG. 1 is a perspective view of an ashtray in an open or unfolded position illustrating a first embodiment of the present invention.

FIG. 1 is a perspective view of an ashtray illustrating a first preferred embodiment of the invention. As shown in FIG. 1, ashtray 20 comprises a folded member 22 which includes two side panels 22*a* and 22*b* having a common edge 22*c*. Folded member 22 is such that the two side panels are moveable towards or away from each other about their common edge 22*c*. Two adjoining edges 22*d*, 22*e* of the two side panels contiguous with the common side 22*c* are shaped to contact a supporting surface to support the two side panels in upright positions as shown in FIG. 1. The edges 22*d* and 22*e* are straight which allows them to be placed on flat supporting surfaces such as table tops or counter tops. Edges 22*d* and 22*e* of the panels define the bottom side of the ashtray. The two side panels include and define an angular space 24 between them. Angular space 24 has an apical portion 24' near the common side 22*c* of the two panels.

Ashtray 20 further includes an inside assembly extending between the two panels 22*a* and 22*b* to form the ashtray 20. The inside assembly includes an upper member 32 connected to the opposing faces of the two panels. The upper member is connected to the two panels at such a position so that when the two panels are in the upright positions, the upper member supports cigarette or cigars thereon in substantially horizontal positions. In the preferred embodiment, member 32 itself is substantially horizontal when the two panels are in the upright positions. The upper member, however, is connected to the two panels 22*a* and 22*b* at such a position that it is spaced away from the common edge 22*c* of the panels. Positioned in this manner the lighted ends of cigars or cigarettes (not shown) may protrude into the apical portion 24' of the angular space between the panels. Ashes (not shown) from such lighted ends will fall through the apical portion towards the bottom side of the ashtray.

Ashtray 20 also includes a lower member 34 connected to the opposing faces of the two panels 22*a* and 22*b* to hold ashes and refuse. Usually, ashtray 20 further includes a wall member 36 extending between the opposing faces of the two panels 22*a* and 22*b* and the upper and lower members 32 and 34. The wall and lower members 36, 34 are of such shape that they, together with the two panels, form a receptacle to securely contain any ash and refuse on the lower member. The opposing faces of the two panels inside the receptacle, the upper, lower and side members are either made of or lined with a fire resistant material.

Figure 4:
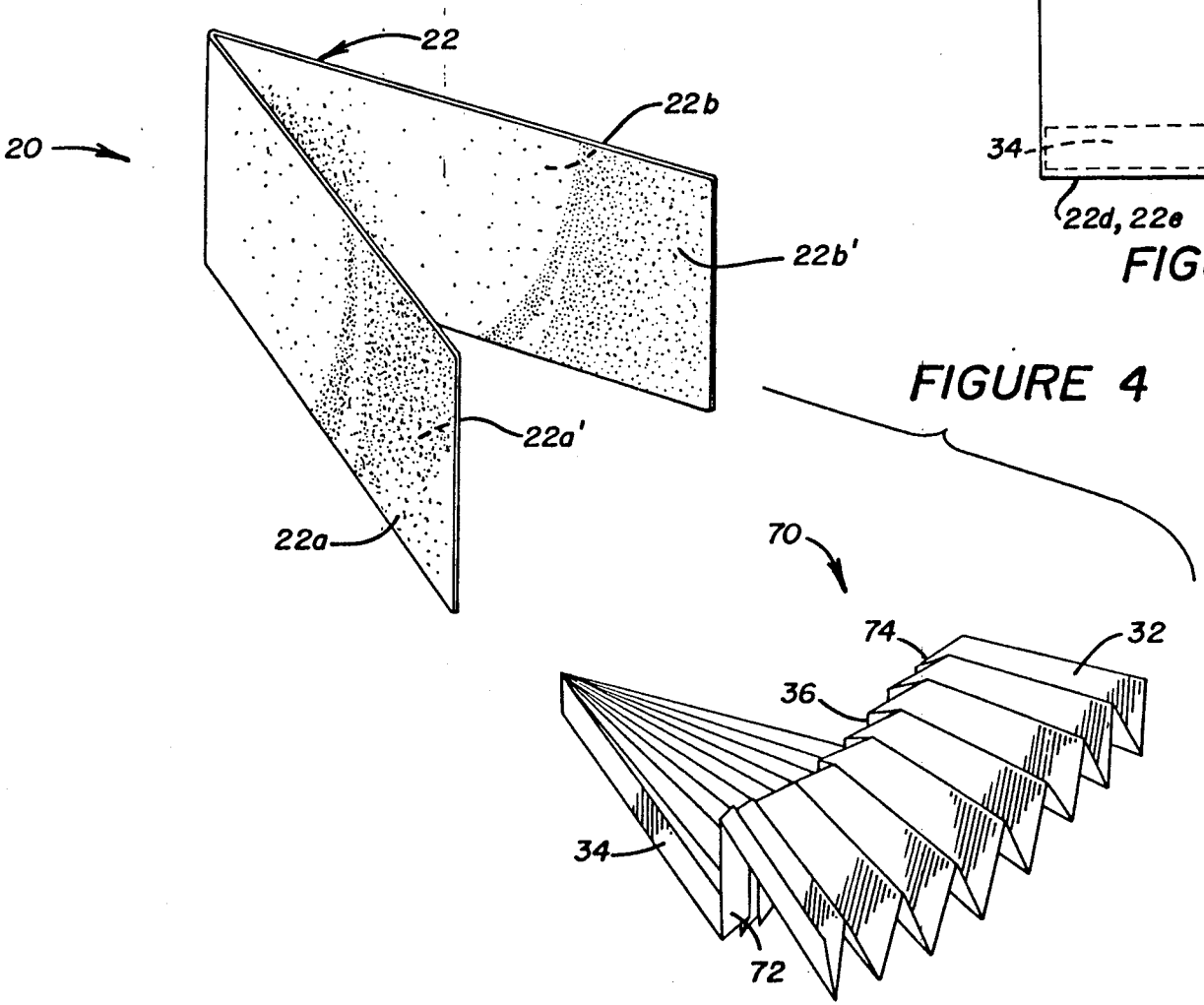
FIG. 4 is an exploded perspective view of the ashtray of FIG. 1.
Figure 15:
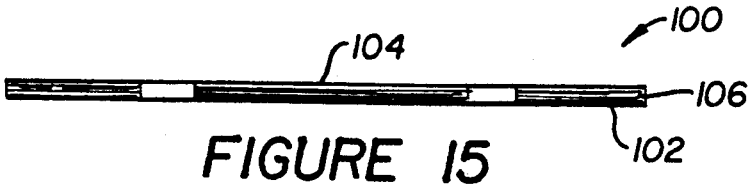
FIGS. 15–18 illustrate a second embodiment of the foldable ashtray of the present invention where the side panels are not directly joined together.

The upper, lower and wall members 32, 34, 36 are made of a material which are collapsible when the panels 22*a*, 22*b* are folded together so that ashtray 20 is collapsible into a flat compact package as shown in FIG. 15. Conveniently, members may be formed from a single pleated sheet which is folded to define a stepped-structure having a first horizontal segment 32 defining the upper member, a second horizontal segment 36 defining the lower member 36, and a vertical segment 34 defining the wall 34. The pleated sheet 70 and its relation to the folded member 22 is best illustrated in FIG. 4.

Figure 2:
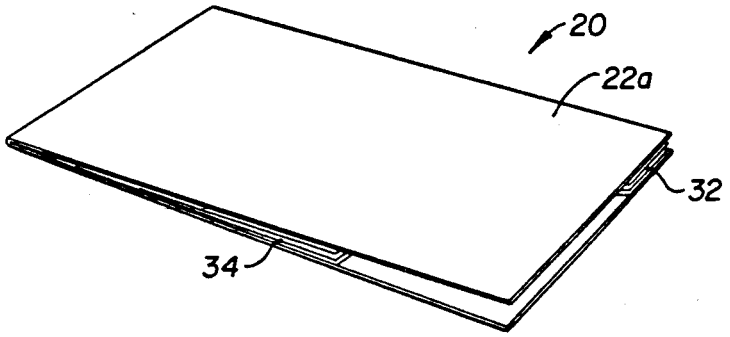
FIG. 2 is a perspective view of the ashtray of FIG. 1 in the closed or folded position with the two side panels folded adjacent to each other.

From the above description, it will be evident that ashtray 20 offers many advantages not available with conventional ashtrays such as those described above. Thus, it is found that the folded member 22 with the two side panels having a V-shaped cross-section offers strong and adequate support on supporting surfaces such as table or counter tops. The upper member 32 and the two side panels together allow cigars or cigarettes to be supported in substantially horizontal positions. No additional support members are required. In its folded or closed position as shown in FIG. 15, ashtray 20 is compact and may be conveniently slipped or carried in pockets or purses. When the folded or closed ashtray is ready to be used all one has to do is to move the side panels 22*a*, 22*b* away from each other to the position shown in FIG. 1 or in FIG. 2. No complicated or time consuming steps are required. This is particularly advantageous since a considerable number of smokers may have lighted a cigarette before getting an ashtray or making it ready for use so that only one hand may be available to manipulate the ashtray. Furthermore, when a user wishes to extinguish a lighted cigarette, cigar or other articles, all that needs to be done is to push the smoldering or burning article onto the lower member 34 and then squeeze the side panels together thereby squashing and snuffing out the smoldering or burning article. In the preferred embodiment the upper, lower and side members are made of a metal foil, such as aluminum or tin foil. The side panels are made of paper and lined with such a metal foil. Constructed in such manner it has been found that users can snuff out lighted cigarettes or cigars with no safety concerns. Constructed in this manner, the ashtray is inexpensive and is disposable.

Figure 3:
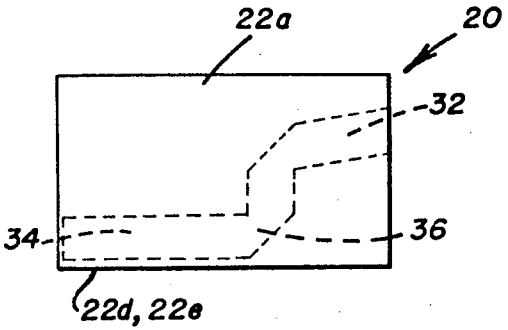
FIG. 3 is a side view of the ashtray of FIG. 1 in the closed or folded position illustrating the different levels of the pleated sheet inside the two side panels.

In the preferred embodiment the lower member 34 is connected to the two side panels at such a position that it is above the bottom sides 22*d*, 22*e* as shown in FIG. 3. With the lower member located in such a manner, smoldering or burning articles on top of lower member 34 are spaced apart from the bottom edge 22*d*, 22*e* so that a heat insulating layer of air is spaced therebetween. It has been found that where lower member 34 is so located, the bottom edges 22*d* and 22*e* may be held by a user by the palm of his or her hand without causing the user to experience any discomfort.

Figure 5:
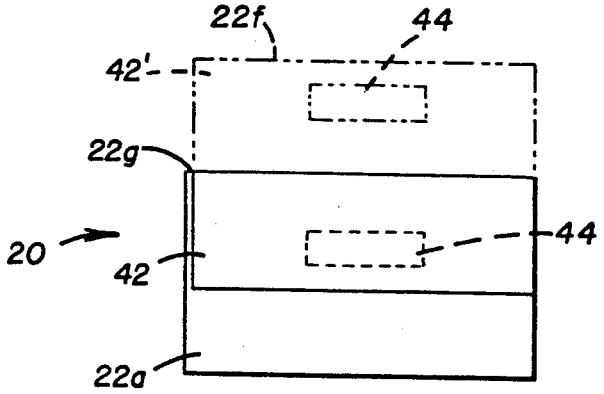
FIG. 5 is a side view of an ashtray of the present invention having a fold-over type flap with adhesive for locking purposes.
Figure 6:
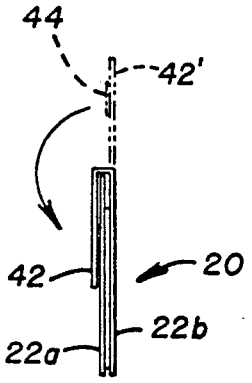
FIG. 6 is an end view of the ashtray of FIG. 5.

With minor modifications as described below, ashes and refuse in ashtray 20 may be securely contained for convenient disposal or for transportation in pockets or purses so that the ashtray can be reused. Such minor modifications are illustrated in FIGS. 5–9 and FIGS. 11–14. FIG. 5 is a side view of the ashtray of FIG. 1 in the folded position modified to include an optional fold-over type flap with adhesive for locking purposes. FIG. 6 is an end view of the ashtray of FIG. 5. As shown in FIGS. 5 and 6 side panel 22*b* is continued upward at its top side 22*f* into a fold-over flap 42 which has been folded over about the top side 22*g* of panel 22*a* to touch and enclose the top portion of side panel 22*a*. The open position of the flap 42 is shown in phantom in FIGS. 5 and 6. The side of flap 42 for contacting side panel 22*a* is provided with adhesive 44 to glue flap 42 onto side panel 22a so as to prevent ashes or refuse in the ashtray from escaping.

Figure 7:
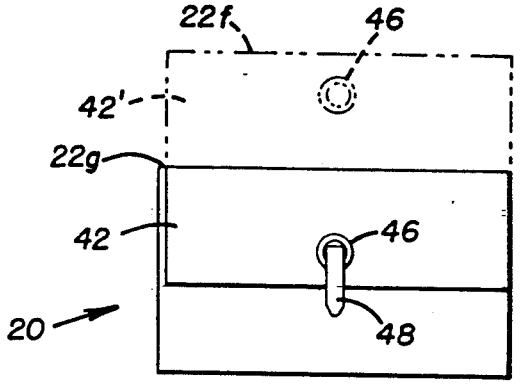
FIG. 7 is a side view of an ashtray of the present invention having a fold-over type flap with a clasp for locking purposes.
Figure 8:
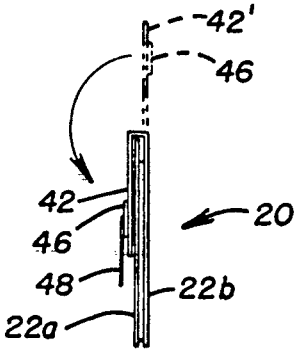
FIG. 8 is an end view of the ashtray of FIG. 7.

FIG. 7 is a side view of the ashtray of FIG. 1 in the folded position modified to include an optional fold-over type flap with a traditional manila envelope type clasp for locking purposes. FIG. 8 is an end view of the ashtray of FIG. 7. As shown in FIGS. 7 and 8, the top side 22f of side panel 22b is again extended upwards to form a fold-over flap 42. The embodiment of FIGS. 7 and 8 differ from that of FIGS. 5 and 6 in that instead of adhesive 44, flap 42 is provided with a hole 46. On the outside surface of side panel 22a is attached a traditional manila envelope type clasp 48 positioned to be inserted into hole 46 when flap 42 is folded over to contact side panel 22a. After such insertion, clasp 48 is bent over to bind flap 42 to panel 22a as shown in FIGS. 7 and 8, thereby securely containing the ashes and refuse inside ashtray 20.

Figure 9:
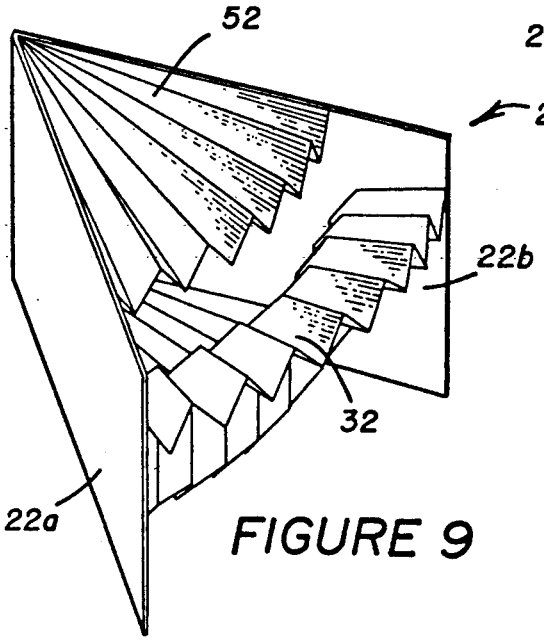
FIG. 9 is a perspective view of an ashtray of the present invention having a hood positioned over the ash receptacle.

FIG. 9 shows yet another modification to the basic design to the ashtray of FIG. 1 to securely contain ashes and refuse. Instead of a flap, a fluted bellows-type hood 52 is connected to the opposing faces of the two side panels at such position that the hood is above the upper member 32 when the side panels are in the upright positions as shown in FIG. 9. Hood 52 helps to trap smoke inside the ashtray as well as trap the extinguished smoking material or refuse in the event that the ashtray is closed and returned to a vest pocket, purse, or for safe and sanitary disposal.

Figure 10:
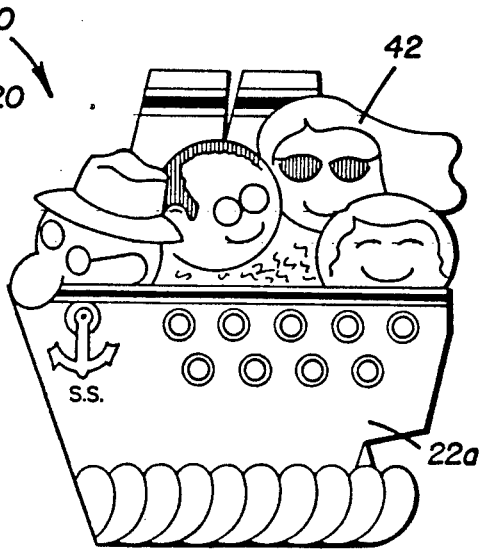
FIG. 10 is a side view of the ashtray of the present invention whose side panel has been modified in shapes desirable for advertising and decoration together with a closure flap with decorative design.

FIG. 10 is the side view of the ashtray of FIG. 1 modified to include a decorative design for side panel 22a and an optional decorative flap 42 which is again an extension of side panel 22b. As shown in FIG. 10, the two side panels and the closure flap may be modified to include decorative designs for decoration or advertising purposes.

Figure 11:
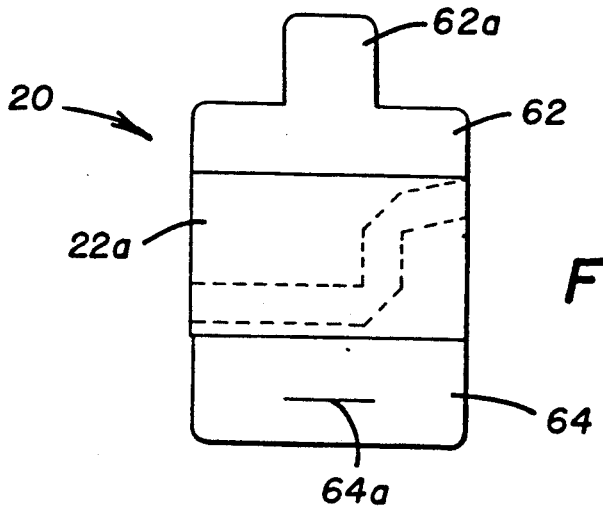
FIG. 11 is a side view of the ashtray of the present invention in the folded or closed position and having two tongue-and-slot fold-over flaps in the unfolded, unlocked position.
Figure 12:
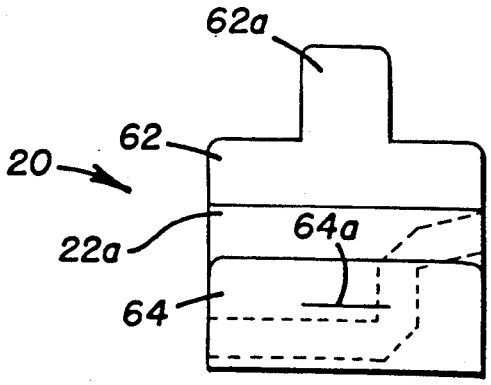
FIG. 12 is a side view of the ashtray of FIG. 11 with the slot fold-over flap in the folded position and the tongue fold-over flap in the unfolded position.
Figure 13:
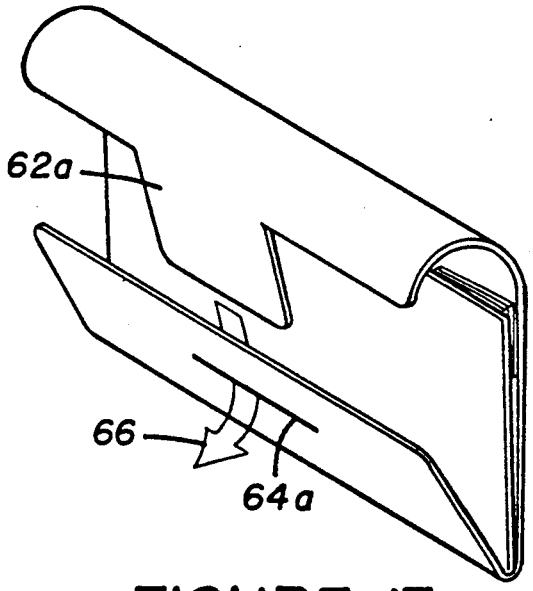
FIG. 13 is a perspective view of the ashtray of FIGS. 11 and 12 showing the tongue and slot flaps in the folded and nearly locked position.

FIG. 11 is a side view of the ashtray of FIG. 1 in a closed position modified to include two optional tongue-and-slot fold-over flaps in the unfolded, unlocked position. As shown in FIG. 11, side panel 22b is extended in both the top and bottom directions into flaps 62 and 64. Flap 62 includes a tongue portion 62a and slot portion 64 includes a slot 64a. The tongue and slot portions are connected in reference to FIGS. 12 and 13 to securely contain the ashes and refuse inside ashtray 20. FIG. 12 is a side view of the ashtray of FIG. 11 with the slot flap folded upwards. Tongue flap 62 remains unfolded. FIG. 13 is a perspective view of the ashtray of FIGS. 11 and 12 with both the tongue-and-slot flaps in the folded and nearly locked position. After the two flaps are folded over to their positions as shown in FIG. 13, the tongue or locking portion 62a is then inserted along arrow 66 shown in dotted lines in FIG. 13 through slot 64a to connect the two flaps.

Figure 14:
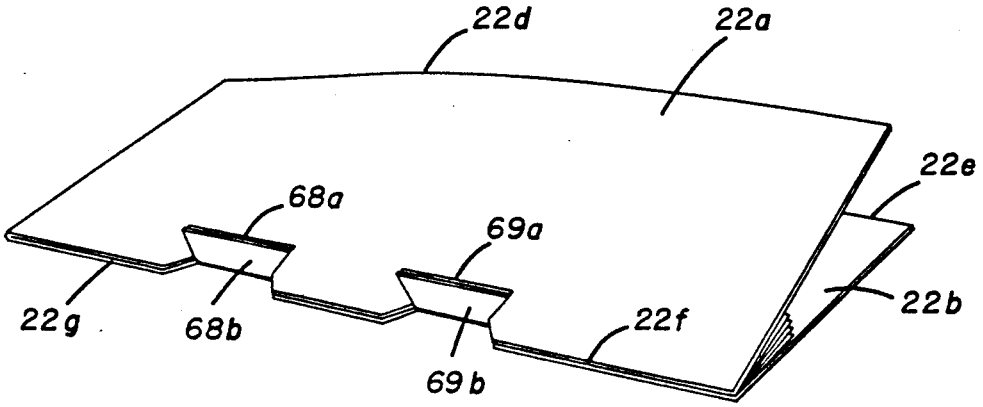
FIG. 14 is a perspective view of an ashtray of the present invention modified to include perforated fold-over taps.

FIG. 14 is a perspective view of the ashtray of FIG. 1 in the folded position modified to include optional perforated fold-over tabs in the unlocked position. Thus, as shown in FIG. 14, the top sides 22f, 22g of the two side panels are both provided with two pairs of fold-over tabs 68a, 68b and 69a, 69b trapezoidal in shape. Each pair of tabs are substantially identical in shape so that they could be folded together over to one side to bind the top sides of the two panels together. One of more pairs of such tabs may be provided. As shown in FIG. 14, each panel has two such tabs.

Figure 16:
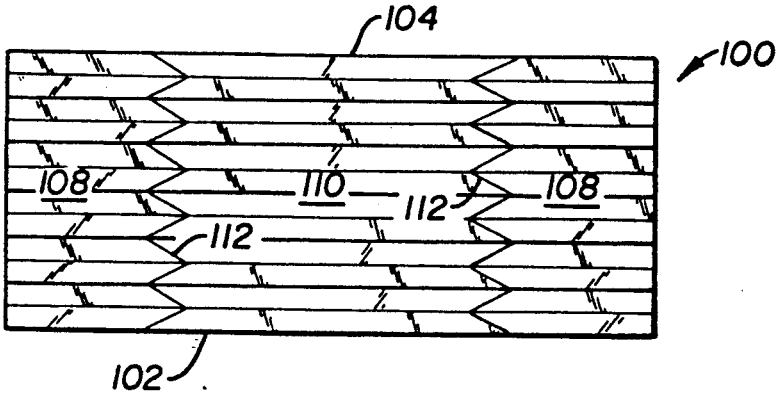
Figure 17:
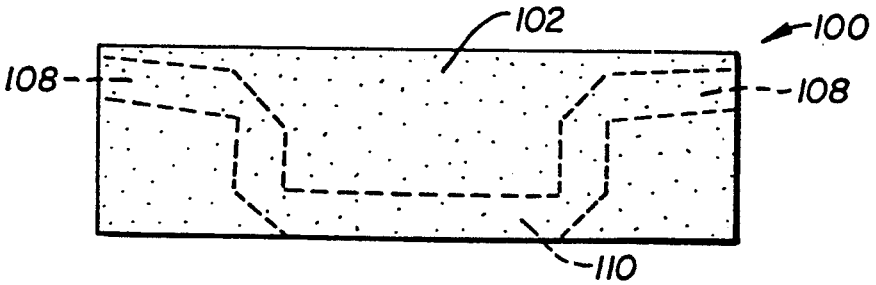
Figure 18:
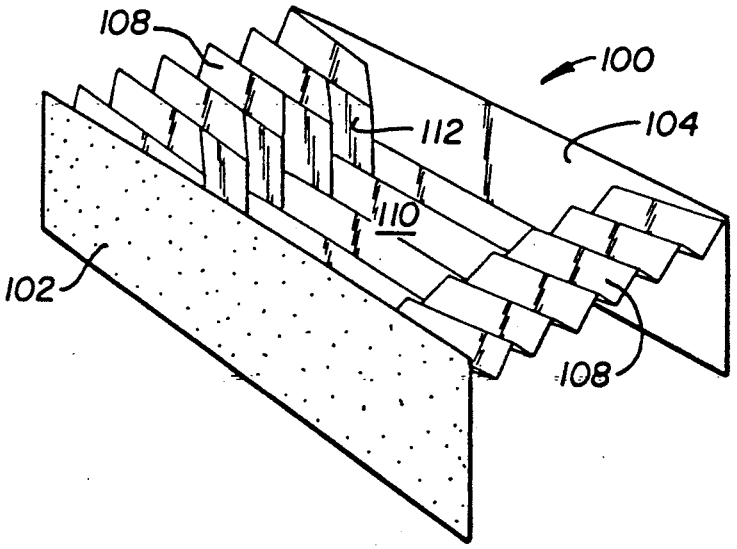

FIG. 16 is an exploded perspective view of the folded member 22 and the upper, lower and side members, 32, 34, 36 of FIG. 1, illustrating a method of making ashtray 20. As shown in FIG. 16 the upper, lower and side members, 32, 34, 36 may be simply constructed from one sheet of aluminum or tin foil pressed in a conventional manner to form the stepped structure 70 of FIG. 16. Member 22 may be simply constructed from paper lined with aluminum or tin foil on the inside surface 22a' and 22b'. Structure 70 has sides 72 and 74, formed by the adjoining sides of the upper, side and lower members. Sides 72 and 74 are then attached by a conventional means such as gluing to the tin or aluminum lining on the inside surfaces 22a' and 22b' of the two side panels. The manufacture of ashtray 20 is then completed and may be used in the manner described above. Thus, the ashtray of this invention described above is also advantageous because of its simple method of manufacture. The entire ashtray is made of two separate members each of which is simple and inexpensive to manufacture. The ashtray of this invention is also advantageous in that it is sturdy and retains its shape after being used for a number of times. Hence, while in the preferred embodiment the ashtray is designed to be disposable, it is sturdy enough to withstand repeated usages.

Referring now to FIGS. 15–18, a second embodiment 100 of the present invention will be described. The second embodiment 100 is characterized by panels 102 and 104 which are not directly secured or joined to one another. Instead, the panels are joined only by a pleated sheet 106 defining a pair of upper horizontal segments 108, lower horizontal segment 110, and vertical wall segments 112. The construction of the second embodiment 100 is similar to that of the first embodiment 20, where the side panels 102 and 104 are typically made from cardboard lined with a fire-resistant material, such as a metal foil, and the pleated member 106 is formed from a metal foil which may or may not be reinforced with cardboard. The embodiment may employ virtually any of the clasping systems described in conjunction with the first embodiment, as well as other clasping systems.

The above description of method and construction used is merely illustrative thereof and various changes and shapes, sizes, materials, or other details of the method and constructions may be within the scope of the appended claims.

What is claimed is:

1. A collapsible ashtray comprising:

a pair of panels composed of a first material; and a continuous pleated sheet composed of a second material and extending between said panels, said sheet defining an upper horizontal segment, a lower horizontal segment, and a vertical wall joining the upper and lower horizontal segments, wherein the lower horizontal segment and the vertical wall together define a receptacle for receiving ashes and the upper horizontal segment defines a ledge adjacent the receptacle adapted to hold a cigar or cigarette and wherein said first material is different than said second material.

2. An ashtray as in claim 1, wherein the pleated sheet is formed from a metal foil.

3. An ashtray as in claim 1, wherein the panels are joined along a common edge so that the panels diverge from said common edge when separated.

4. An ashtray as in claim 1, wherein the panels are formed from cardboard laminated to a metal foil.

5. A collapsible ashtray comprising:

a pair of panels composed of a first material and joined along a common edge to define a hinge so that the panels may be opened and closed about said hinge;

a continuous pleated sheet composed of a second material and extending between the panels, said sheet defining (a) a lower horizontal segment which defines a receptacle for receiving ashes, (b) an upper horizontal segment which defines a ledge adjacent to and above the receptacle when the common edge is in a substantially vertical orientation and the ashtray is upright, said ledge including a plurality of pleats being adapted to hold two or more cigars or cigarettes, and (c) a vertical wall joining the upper and lower horizontal segments and wherein said first material is different than said second material.

6. An ashtray as in claim 1, wherein said pleated sheet is formed from metal foil.

7. An ashtray as in claim 5, wherein said panels are formed from cardboard laminated to a metal foil.

8. The ashtray of claim 1, further comprising a hood member extending between the two panels for trapping any smoke from lighted cigarettes or cigars supported by the upper member.

9. A collapsible ashtray comprising:

a pair of panels formed from a first material, each panel having a straight lower edge, a first end, and a second end;

a first foldable upper member formed from a second material and extending between the two panels from the first end to a termination point part way toward the second end and being spaced-above the lower edges, said upper member defining a substantially horizontal surface for supporting cigarettes or cigars when the panels are drawn apart and placed in an upright position, said horizontal surface including a plurality of grooves for supporting cigars or cigarettes;

a foldable lower member formed from the second material and extending between the lower edges of the panels from the termination point of the first foldable upper member toward the second end of the panels and defining a receptacle for ashes; and a first foldable vertical wall formed from the second material and joining the upper and lower members at the termination point, wherein said first material is different than said second material.

10. A collapsible ashtray as in claim 9, wherein the panels are joined along a common edge at their second ends.

11. A collapsible ashtray as in claim 9, further including a second foldable upper member extending between the panels from the second end to a termination point part way toward the first end.

12. A collapsible ashtray as in claim 11, further including a second foldable vertical wall joining the second foldable upper member and the lower member.

* * * * *